United States Patent [19]

Yokoyama

[11] Patent Number: 4,673,942

[45] Date of Patent: Jun. 16, 1987

[54] ARRAY ANTENNA SYSTEM

[75] Inventor: Hiroshi Yokoyama, Tokyo, Japan

[73] Assignee: NEC Corporation, Tokyo, Japan

[21] Appl. No.: 668,800

[22] Filed: Nov. 6, 1984

[30] Foreign Application Priority Data

Nov. 9, 1983 [JP] Japan ..... 58-210344

[51] Int. Cl.[4] ..... H01Q 3/26

[52] U.S. Cl. ..... 342/368; 342/375

[58] Field of Search ..... 342/368–375

[56] References Cited

U.S. PATENT DOCUMENTS

| | | | |
|---|---|---|---|
| 3,295,138 | 12/1966 | Nelson | 343/375 |
| 4,101,902 | 7/1978 | Trigon | 343/374 |
| 4,321,605 | 3/1982 | Lopez | 343/368 |

OTHER PUBLICATIONS

M. Skolnik, *Intro. to Radar Systems;* (McGraw-Hill, 1980), pp. 286–288.

Butler, "Microwave Scanning Antennas", Array Systems, vol. III, 1966, pp. 246–259.

"Antenna Engineering Handbook", edited by Electro Communication Society, 1980, p. 223.

*Primary Examiner*—Theodore M. Blum

*Assistant Examiner*—Bernarr Earl Gregory

*Attorney, Agent, or Firm*—Schwartz, Jeffery, Schwaab, Mack, Blumenthal & Evans

[57] ABSTRACT

A multibeam array antenna system (3) has a matrix configuration defined by first series power feedlines (21, 22) and second series power feedlines (4*a* to 4*h*) serially connected to radiation elements (5*a* to 5*h*) wherein directional couplers (31*a* to 31*h*, 32*a* to 32*h*) are provided at intersections of the matrix, respectively. This antenna system (3) comprises a plurality of first phase adjusting delay lines (7*a* to 7*h*) connected between output terminals (8*a* to 8*h*) and the radiation elements (5*a* to 5*h*) whereby the aperture phase distribution deviates symmetrically with respect to the central portion of the aperture as compared to the distribution at the time of the in-phase excitation, thus enabling to considerably suppress spurious lobes appearing due to the configuration of the matrix feed network and to set the crossover level between adjacent beams to be high. Preferably, this antenna system (3) further comprises a plurality of second phase adjusting delay lines (9*a* to 9*h*), thus making it possible to reduce frequency variations in the direction of radiating beam.

8 Claims, 6 Drawing Figures

ARRAY ANTENNA SYSTEM

BACKGROUND OF THE INVENTION

The present invention relates to an improvement in a multibeam array antenna for use in a radar, and more particularly to a multibeam array antenna based on a matrix 5 feed network system.

In radars, e.g. three dimentional radars which need precise information indicative of distance, azimuth and height or altitude in respect of a target, particularly, the accuracy of the azimuth and the height depends in large part upon antenna characteristics. For such radar antennas, pencilbeam array antennas having sharp directivity are suitable and there has been widely employed a system of scanning a predetermined space with the pencilbeam antenna at a high speed. However, such a scanning system using a single beam essentially requires an appreciable time for scanning the predetermined space, resulting in a restriction on the data updating rate for the target information, which is one of the important performance characteristics for radars.

To eliminate this restriction, a multibeam antenna system which concurrently forms a plurality of beams with the same antenna has been proposed. As one of methods of forming a beam suitable for the multibeam antenna system, the matrix feed network system is well known. This system is, for example, described in "Antenna Engineering Handbook" edited by Electro Communication Society and published by Ohm-Sha P 223, and "Microwave Scanning Antennas" edited by R.C. Hansen and published by Academic Press (1966) VOL. III, PP. 247–258 etc., and will be described in detail with reference to FIGS. 1 to 3.

Referring to FIG. 1, there is shown an example of eight-element, two-multibeam array antenna based on the prior art matrix feed network system. This array antenna designated by reference numeral 3 is configured in a matrix manner, which comprises multibeam ports 11 and 12 for input powers, a first series power feedline including power feedlines 21 and 22 connected, at one end, to the multibeam ports 11 and 12 and directional couplers 31*a* to 31*h* and 32*a* to 32*h*, radiation elements 5*a* to 5*h* for forming a beam, a second series power feedline including power feedlines 4*a* to 4*h* for mutually coupling the directional couplers 31*a* to 31*h* and 32*a* to 32*h* associated with the first series power feedline and the radiation elements, and resistive terminations 6*a* to 6*h* coupled to the power feedlines 4*a* to 4*h* and resistive terminations 6*i* and 6*j* coupled to the other end of the respective power feedlines 21 and 22.

FIG. 2 generally depicts beams formed by the array antenna shown in FIG. 1.

The basic operation of the above-mentioned antenna will be described with reference to FIGS. 1 and 2. Input power to the beam port 11 is successively distributed to the radiation elements 5*a* to 5*h* by the directional couplers 31*a* to 31*h* provided on the first series power feedline 21, thus forming a beam 1 shown in FIG. 2. Likewise, input power to the beam port 12 is also successively distributed to the radiation elements 5*a* to 5*h* by directional couplers 32*a* to 32*h* provided on the second series power feedline 22, thus forming a beam 2 shown in FIG. 2.

As far as the flow of the input power applied to the beam port 12 within the power feeding circuit is concerned, the following operation must be taken into consideration in addition to the above-mentioned basic operaiton.

Namely, the input power to the beam port 12 is normally transmitted to the second series power feedlines 4*a* to 4*h* by the directional couplers 32*a* to 32*h* thereby to excite the radiation elements 5*a* to 5*h*. However, in this power transmission, the input power partially leaks to the first series power feedline 21 through the directional couplers 31*a* to 31*h* to excite the radiation elements 5*a* to 5*h* through the directional couplers 31*a* to 31*h* provided on the first series feedline 21. The leakage power is radiated in the beam direction determined in principle by the first power feedline 21, i.e. in the direction of the beam 1. Accordingly, such a radiating beam due to the leakage power serves as a spurious lobe with respect to the beam 2 formed by exciting the beam port 12.

For instance, when the degrees of coupling of all the directional couplers are equal to each other, the level difference ($L_s$) between the spurious lobe and the main beam is approximately expressed by the following equation in accordance with the above-mentioned reference "Microwave Scanning Antennas" P 254, $$L_s(\text{dB}) \cong 20 \log_{10}(4\pi b/E) \quad (1)$$

where b is the beam interval or the beam separation angle in beam width between the radiation beams 1 and 2 normalized by the half power width, and E is the efficiency of the feed network. For instance, if the beam interval b is set to the value equal to the half-power width (b=1) and the efficiency of the feed network is 75% (E=0.75), the level difference is expressed as $L_s$=24.5 dB in acccordance with the above-mentioned equation (1). Namely, as shown in FIG. 3, with resepct to the main lobe of the beam 2, the spurious lobe 2*a* is generated in the direction of the beam 1, and has the level of −24.5 dB with resepct to the level of the main beam. In FIG. 3, the ordinate and the abscissa denote relative power and beam angle, respectively.

In general, the radar antennas are required to have low sidelobe and high efficiency. Accordingly, it is necessary to enlarge the beam separation angle b in order to meet this requirement in accordance with the relationship expressed by the equation (1). However, if the beam separation angle b is enlarged, the gain of the antenna at an angular crossover point of both the beams, i.e. a crossover level, will necessarily be lowered. As a result, there arises a problem that a necessary region for a radar system cannot be formed at this angular direction.

For this reason, the multibeam antenna based on the prior art matrix feed network system is disadvantageous in that there exists a restrictive relationship between the level of the spurious lobe and the crossover level between adjacent beams.

SUMMARY OF THE INVENTION

With the above in mind, an object of the present invention is to provide a multibeam array antenna based on the matrix feed network system which can solve the above-mentioned drawbacks.

Another object of the present invention is to provide an array antenna system which can suppress the spurious lobe level and which can set the crossover level between adjacent beams to be high.

According to the present invention, there is provided a multibeam array antenna system having a matrix of a plurality of first and second series power feedlines intersecting with each other, in which matrix the first series power feedlines have respective beam ports for input power, the number of the first series power feedlines being equal to that of beams concurrently formed, the second series power feedlines have output terminals, a plurality of radiation elements are connected to the output terminals, and a plurality of directional couplers are located at the intersections of the matrix, wherein a plurality of first phase adjusting means are provided between the output terminals of the second series power feedlines and the radiation elements, the first phase adjusting means being so set that the aperture phase distribution deviates symmetrically with respect to the central portion of the aperture as compared to the aperture phase distribution at the time of the in-phase excitation.

The aperture phase distribution is such that the aperture phase successively lags or leads from the central portion of the aperture towards both or opposite ends thereof.

To realize such aperture phase distribution, the first phase adjusting means may comprise delay lines wherein the line adjustment is such that each line length successively increases or decreases from the central portion of the aperture toward both or opposite ends thereof.

Preferably, the multibeam array antenna system may further includes a plurality of second phase adjusting means comprising delay lines provided between the output terminals of the second series power feedlines and the plurality of first phase adjusting means, respectively. Thus, the second phase adjusting means allows phase differences due to the location of the output terminals to be substantially constant regardless of variations in an operational frequency.

BRIEF DESCRIPTION OF THE DRAWINGS

The features and advantages of an array antenna system according to the present invention will become more apparent from the following description taken in conjunction with the accompanying drawings, in which.

DETAILED DESCRIPTION OF THE PREFERRED EMBODIMENTS

The preferred embodiments according to the present invention will be described with reference to the accompanying drawings.

Figure 4:
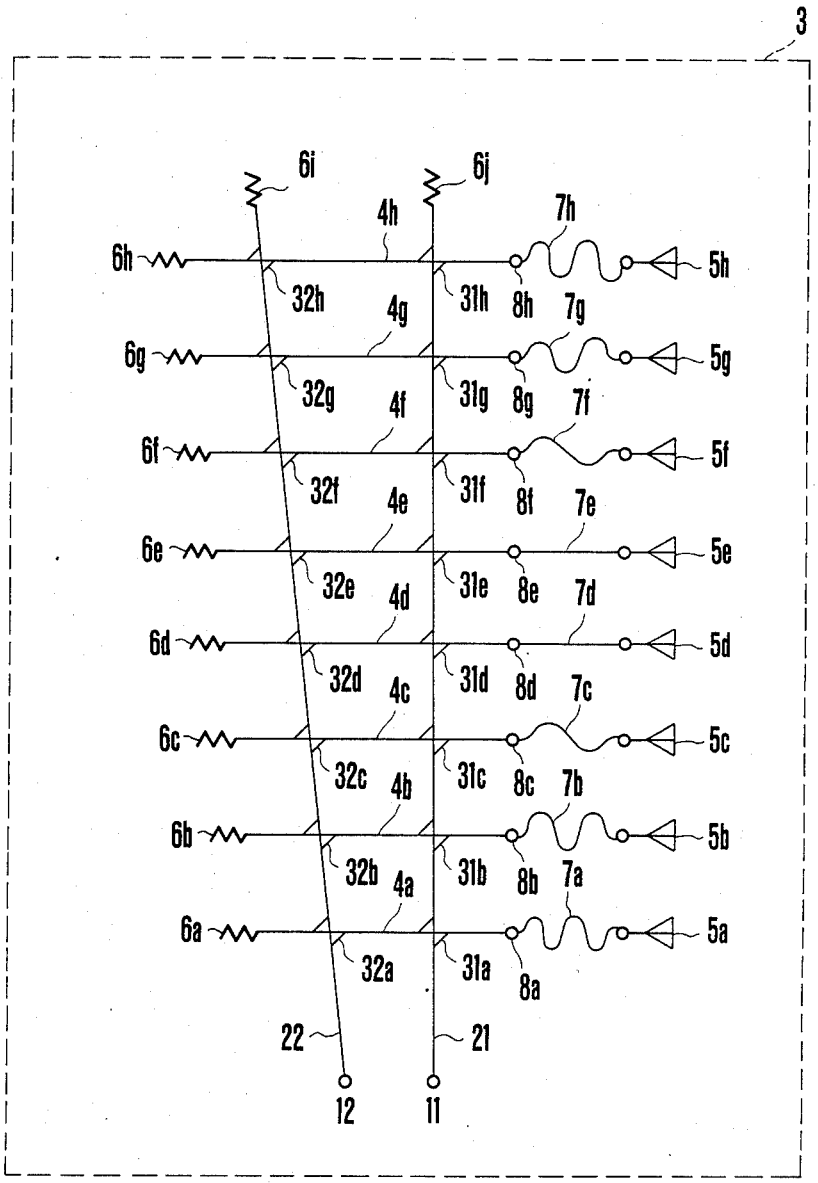
FIG. 4 is a circuit diagram schematically illustrating a first embodiment of an array antenna system according to the present invention.

Referring to FIG. 4, there is shown a circuit diagram of a first embodiment of an eight-element, two multibeam array antenna according to the present invention.

Figure 1:
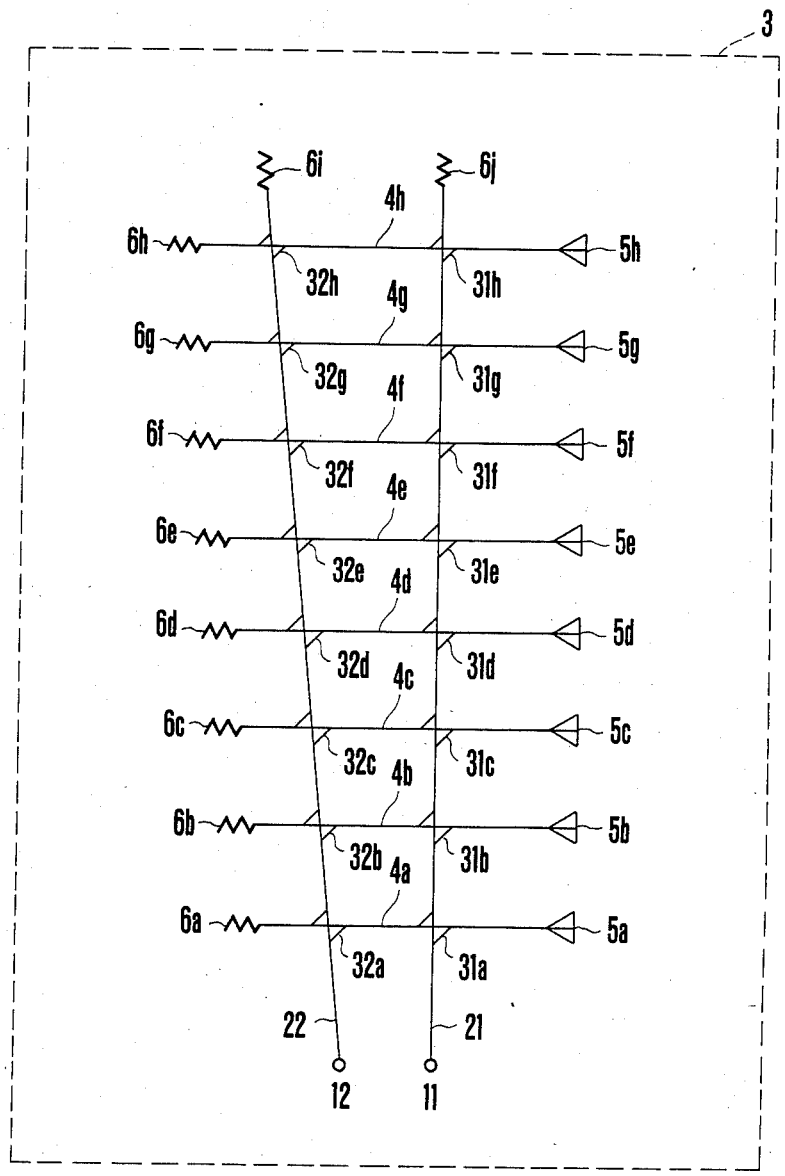
FIG.1 PRIOR ART
FIG. 1 is a circuit diagram schematically illustrating a two-multibeam array antenna configured using a prior art matrix feed network.

Similarly to the conventional array antenna system shown in FIG. 1, the array antenna system 3 of the first embodiment has a matrix configuration defined by a plurality of first and second series power feedlines intersecting with each other. The first series power feedlines 21 and 22 have input terminals 11 and 12 serving as beam ports, resepectively, and their far-ends are terminated by resepective resistive terminations 6*i* and 6*j*. The second series power feedlines 4*a* to 4*h* have output terminals 8*a* to 8*h* to be connected to resepective radiation elements 5*a* to 5*h* and their far-ends are terminated by resistive terminations 6*a* to 6*h*, respectively. A plurality of directional couplers 31*a* to 31*h* and 32*a* to 32*h* are located at the intersections of the matrix.

In this embodiment, a plurality of first phase adjusting means 7*a* to 7*h* each comprising a delay line are provided between the output terminals 8*a* to 8*h* and the radiation elements, respectively. As will be discussed later, by adjusting each line length of the first phase adjusting means 7*a* to 7*h*, an aperture phase distribution can be obtained which deviates symmetrically with respect to the central portion of the aperture as compared to that at the time of the in-phase excitation.

Figure 2:
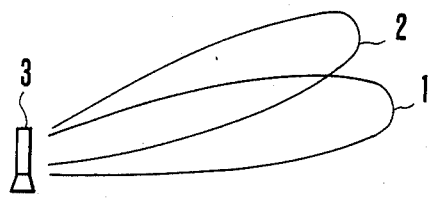
FIG. 2 is an explanatory view showing in a concenptional manner how the multibeam is formed.
Figure 3:
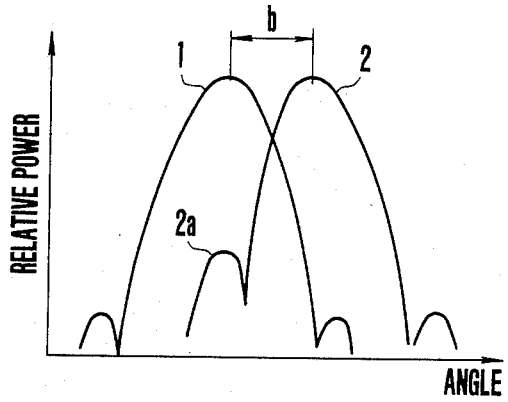
FIG. 3. is a graph showing radiation directivity characteristic according to the prior art.

In FIG. 4, input power applied to the beam ports 11 and 12 are radiated as beams 1 and 2 as shown in FIG. 2 toward a space on the basis of the same principle as that of the prior art. It is here noted that the beam interval between both the beams is set such that the level of the above-mentioned spurious lobe is below a predetermined value. For instance, with reference to the equation (1), when the efficiency of the feed network is 75% (E=0.75), it is appreciated that it is sufficient for more than 30 dB suppression of the spurious lobe that the beam interval between both the beams is two times larger than the half-power width of the radiating beam (b=2) when the radiation elements are in-phase excited, i.e. when all delay lines 7*a* to 7*h* shown in FIG. 4 have the same line length.

Figure 5:
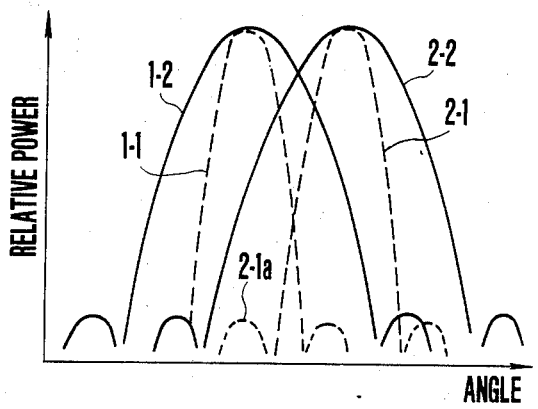
FIG. 5 is a graph showing radiation directivity characteristic in the first embodiment shown in FIG. 4.

FIG. 5 is a graph showing the radiation directivity characteristic of the array antenna system 3 shown in FIG. 4. In this figure, the beams 1-1 and 2-1 show directivity characteristics when the delay lines 7*a* to 7*h* have all the same line length, wherein the beam interval b is two times larger than the half-power width, thus suppressing the level of the spurious lobe 2-1*a* to be less than −30 dB.

Each line length of the delay lines 7*a* to 7*h* of the array antenna system 3 can be desirably set. Thus, in this embodiment, the setting of the line length is carried out symmetrically in the upper and lower directions in the figure such that each line length of the delay lines 7*a* to 7*h* successively increases from the central portion of the aperture towrard both ends thereof. Namely, each length of the delay lines 7*d* and 7*e* located in the central portion of the aperture is the shortest while the length of each of the delay lines 7*a* and 7*h* located at both ends is the longest. As a result, the excitation phase distribution on the aperture deviates from the in-phase excitation distribution. Thus, the excitation phase distribution shows a distribution which deviates symmetrically in the upper and lower directions so that the phase successively lags from the central portion of the aperture toward both ends. Accordingly, the adjustment of the phase distribution pattern can allow the radiating beam width to be broader than the beam width at the time of the in-phase excitation. For instance, cosine distribution etc. is known as a phase distribution pattern for enlarging the beam width. In this instance, since the phase deviating distribution on the aperture is given symmetrically with respect to the central portion thereof, solely the beam width is enlarged without affecting the beam direction.

Since the first phase adjusting means comprising the delay liens 7*a* to 7*h* provides the phase deviating distribution common to both the beams 1 and 2, the two beams are equally enlarged as indicated by beams 1-2 and 2-2 shown in FIG. 5. Thus, this makes it possible to form a multibeam in which the spurious lobe is suppressed and the crossover level of both the beams is raised.

Figure 6:
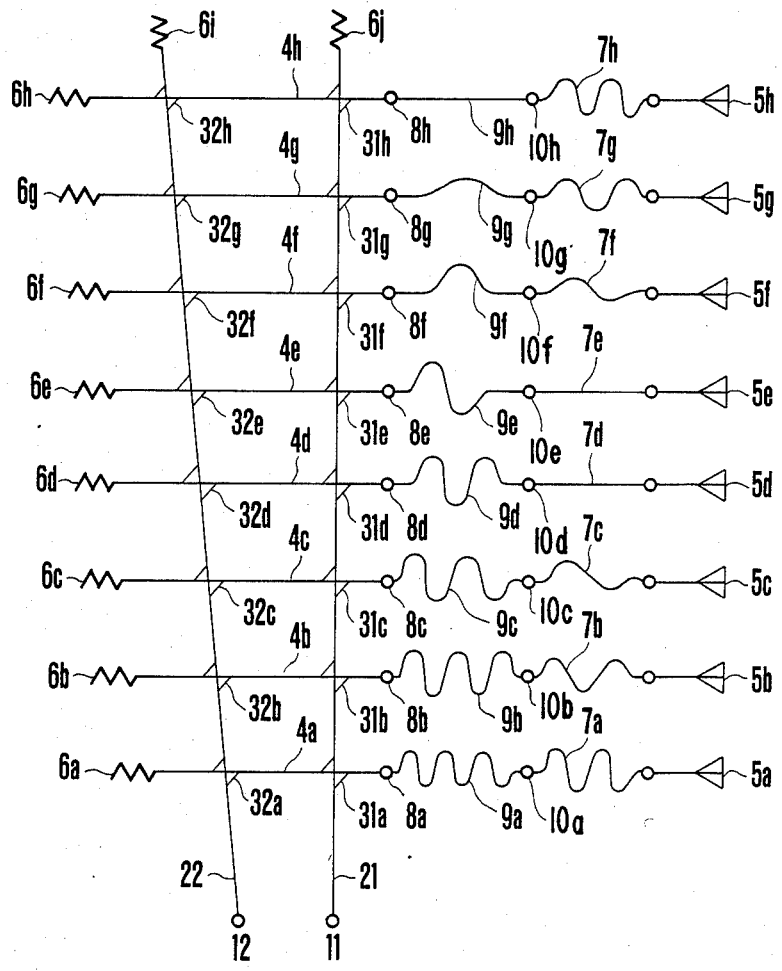
FIG. 6 is a circuit diagram schematically illustrating a second embodiment of an array antenna system according to the present invention.

FIG. 6 is a circuit diagram showing a second embodiment of eight-element, two multibeam array antenna similar to that of the first embodiment according to the present invention.

In the second embodiment, the same or similar parts identical to those in the first embodiment are designated like reference numerals, respectively, and their explanation will be omitted.

The second embodiment is characterized in that second phase adjusting means comprising delay lines 9*a* to 9*h* are provided between output terminals of the second series power feedlines 4*a* to 4*h* and the plurality of first phase adjusting means 7*a* to 7*h*.

In this embodiment, each line length of the delay lines 9*a* to 9*h* serving as the second phase adjusting means is adjusted so that each line length from the beam port 11 to respective output terminals 10*a* to 10*h* is the same. Accordingly, the array antenna system according to this embodiment allows phase differences due to the location of output terminals 8*a* to 8*h* to be substantially constant regardless of changes in an operational frequency. Thus, the array antenna system of the second embodiment can provide the advantage that the change due to the frequency in the beam direction becomes considerably small as compared to that in the first embodiment.

It is to be noted that the operation of the matrix feed network itself in the second embodiment is the same as that in the prior art. If the delay lines 7*a* to 7*h* shown in FIG. 6 have all the same line length, the restrictive relationship between the level of the spurious lobe and the crossover level of the adjacent beam cannot be avoided. However, the feed network according to the second embodiment is also provided with the first phase adjusting means comprising delay lines 7*a* to 7*h* provided between the output terminals 10*a* to 10*h* and the radiation elements 5*a* to 5*h*. Similar to the first embodiment, the setting is carried out symmetrically in the upper and lower directions such that each line length successively increases from the central portion of the aperture phase distribution deviating from the in-phase excitation distribution. As a result, the beam width of both the beams becomes larger than that at the time of the in-phase excitation, thereby enabling formation of a multibeam in which the spurious lobe is suppressed and the crossover level of both the beams is raised in accordance with the same designing principle as that previously described in connection with the first embodiment.

In both the embodiments, each distribution is formed in a manner that the phase at both ends of the aperture lags with respect to that of the central portion thereof as a distribution deviating from the in-phase excitation of the aperture. However, conversely to this, it is possible to enlarge the beam width as compared to the in-phase excitation by making use of the distribution in which the phase at both ends leads with respect to that in the central portion of the aperture. Further, although it has been described that the delay lines are used as the first and second phase adjusting means, according to the present invention, it is not limited that the phase adjusting means comprise delay lines, for instance, and the phase adjusting means may be other means e.g. digital phase shifter etc. Furthermore, the array antenna systems in both the embodiments have been described in connection with the two-multibeam, eight-element array antenna. However, the present invention is in no way limited to the system having the above-mentioned number of multibeam and the radiation elements, and therefore is applicable to other systems having desired number thereof.

As stated above, according to the present invention, the multibeam array antenna using the matrix feed network system is characterized in that the plurality of phase adjusting means are provided between the output terminals on the side of the radiation elements and the radiation elements in the matrix feed network, to adjust the first phase adjusting means so that the aperture phase distribution deviates symmetrically with respect to the central portion of the aperture as compared to that at the time of the in-phase excitation. Thus, the array antenna system of the invention can suppress the spurious lobe existing in the matrix feed network and set the crossover level of the adjacent beams to be high. Further, when the second phase adjusting means are provided, in addition to the first phase adjusting means, between the output terminals of the second series power feedlines and the plurality of the first phase adjusting means, phase differences due to the location of the output terminals can be made substantially constant regardless of variations in an operational frequency, thereby enabling to remarkably reduce changes due to frequency in the beam direction.

What is claimed is:

1. A multibeam array antenna comprising:

a plurality of first series power feed lines, the number of which is equal to that of beams to be formed concurrently, each of said plurality of first series power feed lines having an input power port at one end thereof and load element connected to the other end thereof;

a plurality of second series power feed lines intersecting said plurality of first series power feed lines to form a matrix, each of said plurality of second series power feed lines having an output terminal at one end thereof and a load element connected to the other end thereof;

a plurality of radiation elements, one radiation element corresponding to each of said output terminals and including a central radiation element located at a central portion of an aperture of said array and additional radiation elements positioned at given distances on each side of said central element;

a plurality of directional couplers disposed at the intersections of said matrix; and a first phase adjusting means comprising a plurality of delay lines connected between said plurality of radiation elements and said corresponding output terminals of the second series power feed lines, respectively, the lengths of said delay lines being determined such that the delay line connected with said central radiation element has a given reference length, and the delay lines connected with the additional radiation elements have lengths which are different from said reference length by amounts in proportion to said given distances between each additional radiation element and said central radiation element, thereby the phases of radiations from said radiation elements are distributed symmetrically with respect to the central portion of the aperture as compared to the phase distribution at the time of in-phase excitation.

2. A multibeam array antenna system according to claim 1 wherein each of said delay lines is longer than the reference length by an amount in proportion to the given distance between the corresponding additional radiation element and said central radiation element, thereby the phase of each of said radiation elements successively lags from the phase of said central radiation element toward both ends of said aperture.

3. A multibeam array antenna system according to claim 2, wherein said plurality of first phase adjusting means comprise digital phase shifters.

4. A multibeam array antenna system according to claim 1 wherein each of said delay line is shorter than the reference length by an amount in proportion to said given distance between the corresponding additional radiation element and said central radiation element, thereby the phase of each of said radiation elements successively leads from the phase of said central element toward both ends of said aperture.

5. A multibeam array antenna system according to claim 4, wherein said plurality of first phase adjusting means comprise digital phase shifters.

6. A multibeam array antenna system according to claim 1, which further comprises a plurality of second phase adjusting means provided between said output terminals of said second series power feddlines and said plurality of first phase adjusting means, said plurality of second phase adjusting means causing phase differences due to the location of said output terminals to be substantially constant regardless of variations in an operational frequency.

7. A multibeam array antenna according to claim 6, wherein said plurality of second phase adjusting means comprise a plurality of delay lines, the length of each being adjusted so that the distances from said input power port to said output terminals are equal to each other.

8. A multibeam array antenna according to claim 6, wherein said plurality of second phase adjusting means comprise digital phase shifters.

* * * * *